US010485079B1

(12) United States Patent
Cavacuiti et al.

(10) Patent No.: US 10,485,079 B1
(45) Date of Patent: Nov. 19, 2019

(54) CENTRALIZED CONTROLLER INTERFACE, SYSTEM, AND METHOD FOR CONFIGURING DEVICES IN A LIGHTING CONTROL SYSTEM

(71) Applicant: Douglas Lighting Controls, Burnaby (CA)

(72) Inventors: John Cavacuiti, Burnaby (CA); Arif Hossain, Burnaby (CA); Russell Kramer, Burnaby (CA); Tony Lee, Burnaby (CA); Rob Mahaffey, Burnaby (CA)

(73) Assignee: Douglas Lighting Controls, Burnaby, British Columbia (CA)

( * ) Notice: Subject to any disclaimer, the term of this patent is extended or adjusted under 35 U.S.C. 154(b) by 0 days.

(21) Appl. No.: 16/148,850

(22) Filed: Oct. 1, 2018

Related U.S. Application Data

(60) Provisional application No. 62/565,619, filed on Sep. 29, 2017.

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 37/0272* (2013.01); *H05B 33/0845* (2013.01); *H05B 37/0227* (2013.01)

(58) Field of Classification Search
None
See application file for complete search history.

(56) References Cited

U.S. PATENT DOCUMENTS

| | | | | |
|---|---|---|---|---|
| 5,530,322 | A * | 6/1996 | Ference | H05B 37/02 315/293 |
| 10,032,364 | B2 * | 7/2018 | Hamm | G08C 17/02 |
| 2004/0267385 | A1 * | 12/2004 | Lingemann | G05B 15/02 700/83 |

* cited by examiner

*Primary Examiner* — Anh Q Tran
(74) *Attorney, Agent, or Firm* — Patterson Intellectual Property Law, P.C.; Gary L. Montle; Grant M. Ford

(57) ABSTRACT

Apparatuses, systems, and methods are provided for configuring a device of a lighting control system. The method begins by providing a configuration interface by a centralized controller of the lighting control system. Device configuration information is received via the configuration interface. A communication network of the lighting control system is then placed into a programming mode. A programming request received at the device is detected, and configuration data representing at least a portion of the received device configuration information is transmitted from the centralized controller to the device.

18 Claims, 5 Drawing Sheets

CENTRALIZED CONTROLLER INTERFACE, SYSTEM, AND METHOD FOR CONFIGURING DEVICES IN A LIGHTING CONTROL SYSTEM

CROSS-REFERENCES TO RELATED APPLICATIONS

This application claims benefit of U.S. Provisional Patent Application No. 62/565,619, dated Sep. 29, 2017, entitled "Centralized Controller Interface and Method for Configuring Devices in a Lighting Control System," and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present disclosure relates generally to apparatuses, systems, and methods for configuring devices in a control system using a controller interface. More specifically, the present disclosure relates to providing a centralized controller interface, system, and method for configuring devices in a lighting control system.

Modern lighting systems may include programmable or customizable components. Configuring these components may be performed by a manufacturer at time of manufacture of a component, or at a time of preparation, shipment, or delivery to customer when entire lighting systems or sections thereof are provided to the customer. Configuration may also be performed by an installer using a handheld programming device wired or wirelessly coupled to the component to be programmed.

The most common method for configuring lighting control devices such as switches and sensors connected to a centralized control system is to use an infrared (IR) remote. Using an IR remote adds significant cost and complexity to both the centralized controller and the devices. For example, current remote models, such as the WIR-3110 Handheld Infrared Setting Unit for the Douglas control system, may cost more than $50 to manufacture. The cost to produce the IR remote is high because it require a multi-line liquid crystal display (LCD) user interface (UI) to select settings and a sophisticated integrated circuit (IC) to communicate more than 20 different settings to the device for particular implementations. Furthermore, components necessary for a device to receive IR data from an IR remote may cost approximately $1.50, which could translate to additional costs of more than $1000 for a large scale system.

BRIEF SUMMARY OF THE INVENTION

It is thus desirable to provide the ability to configure devices in a lighting control system using a centralized controller to receive device information, to push that device information and/or corresponding device configuration or profile information across at least a portion of the lighting control system, and to use that device configuration or profile information to program at least one device of the lighting control system using a single physical input at the installed device.

Various solutions consistent with the present disclosure may be accomplished by providing an interface on a centralized controller to define device settings. A communications network coupled to the centralized controller and a device may be placed in a programming mode.

Providing programming devices coupled to the communications network, rather than by wireless infrared (IR) remote, total cost of implementation of the lighting system may be significantly reduced, as neither the traditional IR remote nor the IR hardware necessary at the device would be required. Instead, expensive IR hardware may be replaced by vastly less expensive and less complicated wired and wireless communication modules and protocols.

According to an aspect of the present disclosure, provided is a method of configuring a device of a lighting control system. The method begins by providing a configuration interface by a centralized controller of the lighting control system. Device configuration information is received via the configuration interface. A communication network of the lighting control system is then placed into a programming mode. A programming request received at the device is detected, and configuration data representing at least a portion of the received device configuration information is transmitted from the centralized controller to the device.

Configuration data is received at the device, and at least one setting of the device is modified based at least in part upon the received configuration data.

Detecting the programming request received at the device may include detecting a physical input at the device.

Receiving device configuration information may include receiving a device type of the device, and the transmitting configuration data may include transmitting the configuration data to all devices coupled to the lighting control system matching the received device type.

The configuration interface may be presented to a user via a display section of the controller.

Providing the configuration interface by the centralized controller may include providing remote access to the controller via a communication network.

Another aspect of the present disclosure relates to providing a centralized controller for configuring devices in a lighting control system. The lighting control system includes a communication interface coupled to a communication network, a storage section, a display section configured to provide an input interface, the display section configured to display at least one configuration parameter corresponding to the input interface, and a processing section configured to receive a configuration parameter via the input interface, to define at least one setting associated with the configuration parameter, to place the communications network into a programming mode, to store at least a portion of the configuration parameter at the storage section, and to program a device coupled to the communications network while the communications network is in the programming mode.

The storage section may store a plurality of sets of configuration data, at least one of the plurality of sets of configuration data corresponding to the device.

The controller may provide a remote interface configured to receive at least a portion of information associated with the input interface.

A further aspect of the present disclosure relates to providing a control system for configuring devices (for example, as implemented in a lighting control system). The control system includes a communication network, a device coupleable to the communications network, the device including at least one input, and a centralized controller. The centralized controller includes a network interface, a storage section, a display section configured to provide an input interface, the display section configured to display at least one configuration parameter corresponding to the input interface, and a processing section configured to receive a configuration parameter via the input interface, to define at least one setting associated with the configuration parameter, to place the communications network into a programming mode via the network interface, to store at least a portion of the configuration parameter at the storage section, and to transfer at least one set of programming information to the device via the network interface while the communications network is in the programming mode and after determining that the input of the device was selected.

The device may have an associated configuration designation, the configuration designation configured to enable programming of the device while the communications network operates in the programming mode.

The control system may be a lighting control system comprising a plurality of relays and at least one configurable input device.

The device may receive the configuration parameter and modify at least one setting of the device based at least in part upon the received configuration parameter.

Determining that the input of the device was selected may include detecting, by the device, a physical user interaction at the input of the device.

The controller may receive device configuration information including a device type of the device, and may transmit the configuration parameter to all devices coupled to the control system matching the received device type.

The configuration interface may be presented to a user via the display section of the controller.

The controller may provide remote access to at least a portion of the input interface via a communication network.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
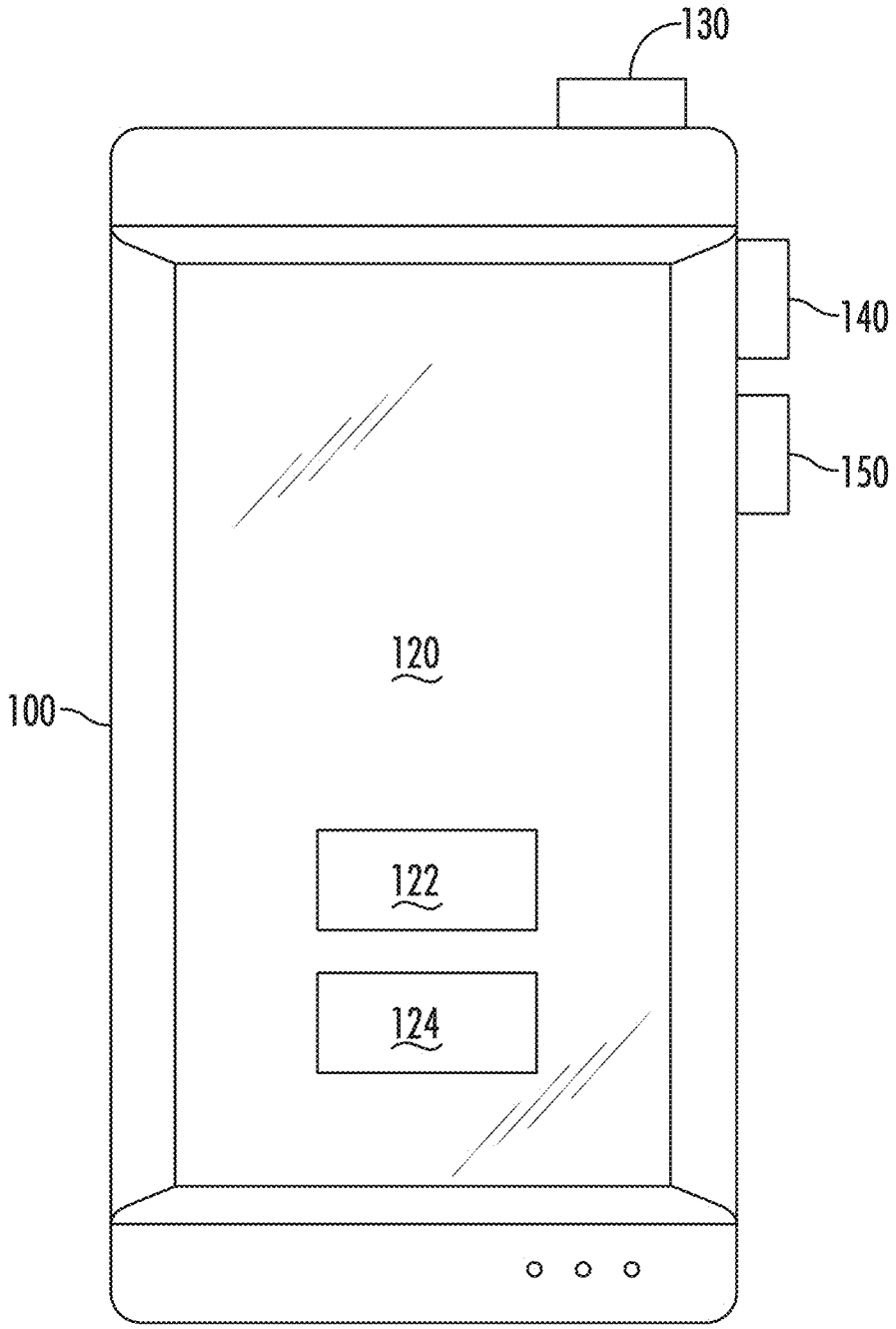
FIG. 1 illustrates a partial block diagram of an exemplary embodiment of a controller according to aspects of the present disclosure.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-5, exemplary apparatuses, systems, and methods for configuring devices in a lighting control system via a centralized controller are provided. As used herein, the term "centralized" may refer to any physical or logical reference with regard to a controller, and in various exemplary embodiments may refer to a controller coupled to a plurality of devices or relays at a common physical or logical space. Where the various figures may describe embodiments sharing various common elements and features with other embodiments, similar elements and features are given the same reference numerals and redundant description thereof may be omitted below.

FIG. 1 illustrates a partial block diagram of an exemplary embodiment of a controller according to aspects of the present disclosure. The controller 100 is a control unit configured to manage centralized facility or multi-facility applications. In one exemplary embodiment, the controller 100 is a lighting control unit (LCU) configured to manage large-scale lighting applications. The controller 100 may be located within a relay panel and may act as the main processor of a lighting control system. A lighting control system incorporating the controller 100 may include one or more of wall switches, dimmers, daylight and occupancy sensors, control cards, and/or peripheral devices (e.g., "devices" as described herein).

The controller 100 includes a body 110 and a display section 120. The display section 120 may include one or more of a liquid crystal display (LCD), a light emitting diode (LED) display, an organic light emitting diode (OLED) display, a cathode ray tube (CRT) display, a plasma display panel (PDP), and/or any other means of visually conveying information from the controller 100. The display section 120 includes at least one of an input interface 122 and/or at least one configuration parameter 124. The input interface 122 is a touchscreen section of the display section 120 or other section capable of receiving input or interpreting input received from a user. Although described as a section of the display section 120, it should be appreciated that the input interface 122 may be an entire output surface of the display section 120 in various embodiments.

The display section 120 is configured to display at least one configuration parameter 124 to a user. The at least one configuration parameter 124 may be any selectable information describing or otherwise in relation to a device (e.g., a device 390 as described herein). For example, the configuration parameter 124 may include, without limitation, a device type, a device name, a device label, a device group name, a device group label, or any other information describing or otherwise in relation to a device or group of devices. Additional description of the at least one configuration parameter 124 is described below in relation to FIG. 4.

The controller 100 includes a network interface 130. The network interface 130 is a communication module configured to permit coupling the controller 100 to one or more wired or wireless communication networks. The network interface 130 may include at least one hardware port (not illustrated) configured to directly or indirectly couple to a wired network, and/or may include at least one wireless transmitter, receiver, or transceiver configured to transmit, receive, or both transmit and receive wireless communications to a wireless network, peer-to-peer, or ad-hoc wireless network. The network interface 130 is configured to transmit and/or receive at least one signal corresponding to a device 390, for example as a device configuration or programming signal as described herein.

The controller 100 includes a processing section 140. The processing section 140 includes one or more hardware or software components configured to perform at least one operation in relation to the controller 100. Although described as being part of the controller 100, it should be appreciated that all or at least a portion of the processing section 140 may be physically and/or logically remote from the controller 100, such as in a distributed or cloud-based implementation. In such distributed or cloud-based implementation, at least a portion of a processing operation, a data operation, and/or data storage, retrieval, or manipulation may be performed at a physical or logical location apart from the controller 100.

The controller 100 may further include a storage section 150. The storage section 150 may include a volatile or non-volatile storage medium. The storage section 150 may be a Random Access Memory (RAM), a Read-Only Memory (ROM), a Solid State Drive (SSD) or any other physical or virtual element capable of permanently and/or temporarily storing at least a portion of data associated with or used by or in conjunction with the controller 100. The storage section 150 is configured in an exemplary embodiment to store one or more predetermined sets of data, such as device profiles or portion thereof, in relation to configuration and/or programming of one or more devices 390 (e.g., one or more configuration designations).

Figure 2:
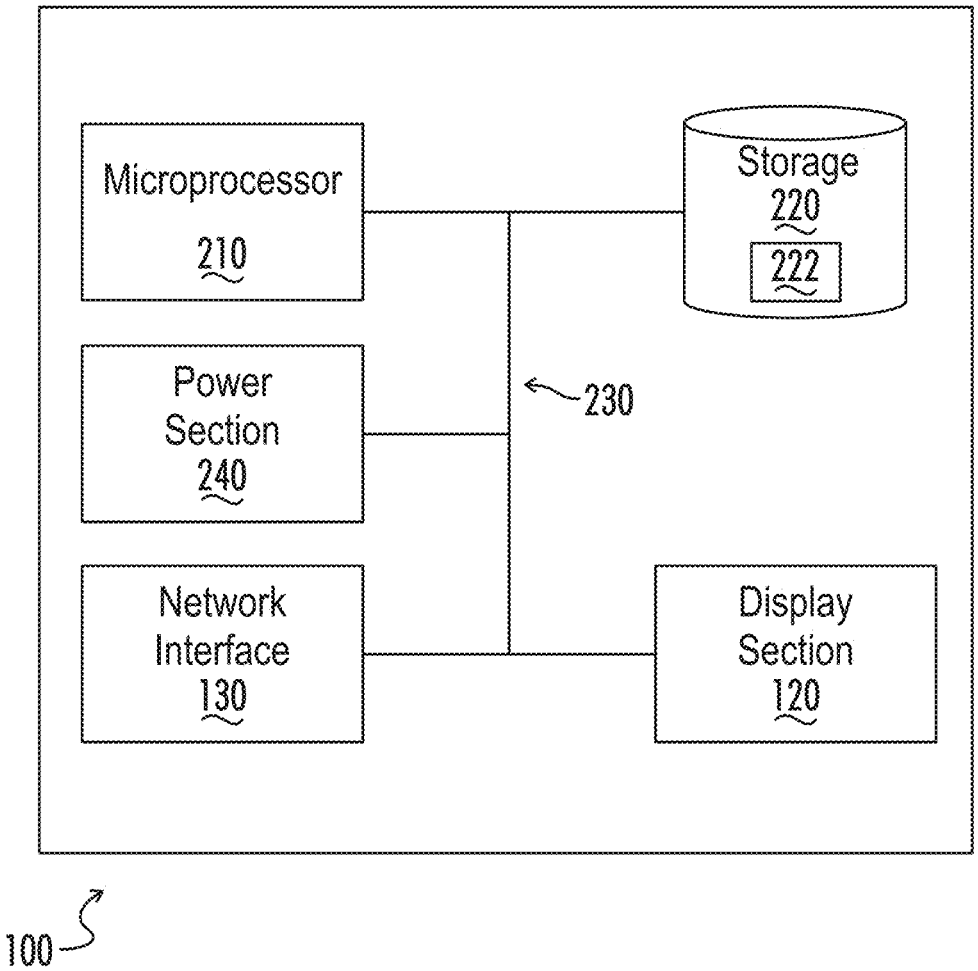
FIG. 2 is a partial circuit schematic of a controller according to an exemplary embodiment.

FIG. 2 is a partial circuit schematic of a controller 100 according to an exemplary embodiment. The controller 110 includes one or more of microprocessor 210, a storage 220, a power section 240, a network interface 130, and/or a display section 120. One or more of the microprocessor 210, the storage 220, the power section 240, the network interface 130 and/or the display section 120 may be coupled to a bus 230. In one exemplary embodiment, each of the microprocessor 210, the storage 220, the power section 240, the network interface 130, and the display section 120 are coupled to the bus 230. The microcontroller 210 may be included as a part or entirety of the processing section 140. In some embodiments, the microcontroller 210 is a commercially-available microcontroller as a generic processor. It should be understood that when the microcontroller 210 executes one or more sets of instructions to perform an operation, a generic processor may be converted into a special purpose processor, specifically implemented to perform at least one function in the manner disclosed herein.

The storage 220 may be a part or entirety of the storage section 150. The storage 220 may include at least one configuration designation 222. Each configuration designation 222 may be associated or associable with at least one device and/or device group. Each configuration designation 222 may be a predefined set of information and/or may be customizable based on a particular installation, version type, or any other parameter associated with a device or control system. The storage 220 may include a non-volatile memory configured to store control programming, such as lighting control programming information used to manage facility lighting configurations.

The power section 240 includes one or more hardware elements configured to receive and/or provide operating power to the controller 100. The power section 240 may be configured to receive at least one of alternating current (AC) and/or direct current (DC) power from an external source. Additionally or alternatively, at least a portion of the power section 240 may be implemented as a capacitive device, such as an internal battery. The power section 240 optionally includes a backup element configured to provide operating power to the controller 100 during programming or configuration, and may be configured to provide operating power to the controller 100 in the event of a power outage from an external power source. The power section 240 may include a two-wire low voltage, non-polarized coupler configured to receive both power and data.

Although each of the microprocessor 210, the storage 220, the power section 240, the network interface 130, and display section 120 are illustrated as being housed within the controller 100, one or more of the microprocessor 210, the storage 220, the power section 240, the network interface 130, and/or the display section 120 may be physically and/or logically within or separate from the controller 100, such as in a distributed or cloud-based implementation. For example, in one embodiment, at least a portion of the storage 220 may include a plurality of device configuration profiles (e.g., configuration designations 222) which are accessible remotely from a physical location of the controller 100.

Figure 3:
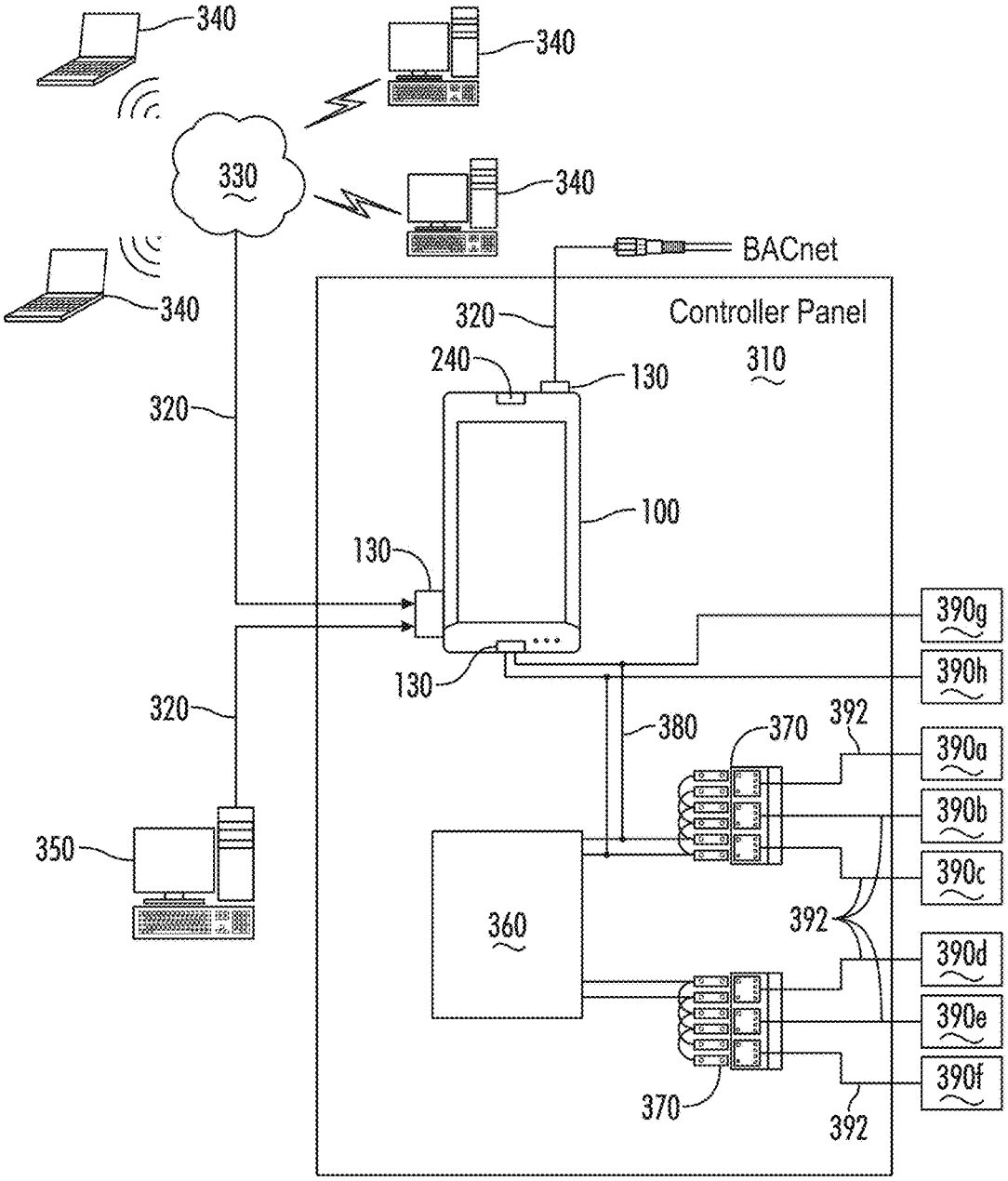
FIG. 3 illustrates an exemplary embodiment of a controller panel coupleable to external electronic devices according to aspects of the present disclosure.

FIG. 3 illustrates an exemplary embodiment of a system including a controller panel coupleable to external electronic devices according to aspects of the present disclosure. The system 300 includes a controller panel 310 having a controller 100 housed within. Although illustrated as being wholly within the controller panel 310, at least a portion of the controller 100 may be internal and/or external to the controller panel in various embodiments. The controller 100 within the controller panel 310 is coupleable to at least one of an external communication bus 320 and/or an internal communication bus 380. Each of the external communication bus 320 and the internal communication bus 380 may be a wired or wireless communication bus.

At least one external communication bus 320 may be coupled to a communication network 330. The communication network 330 may be an internal network, such as an intranet, or a public network such as the Internet, or any combination thereof. The network 330 may be coupled to one or more electronic devices 340. Each electronic device 340 may be a computing element, such as a fixed or moveable computing element such as a desktop computer, a laptop computer, a mobile phone, a tablet, or any other electronic device capable of sending or receiving information via the external communication bus 320. The electronic device 340 is configured in an exemplary embodiment to provide one or more sets of information to the controller 100 via the external communication bus 320 and/or to receive one or more sets of information from the controller 100 via the external communication bus 320. Each electronic device 340 may be coupled to the network 330 via one or more wired or wireless connections. An external communication bus 320 may be coupleable to a Building Automation and Control network (BACnet) system.

In one embodiment, an electronic device 350 may be directly or indirectly coupleable to the controller 100 via the external communication bus 320 in a wired or wireless manner. The electronic device 350 may be a computing element, such as a fixed or moveable computing element such as a desktop computer, a laptop computer, a mobile phone, a tablet, or any other electronic device capable of sending or receiving information via the external communication bus 320. The electronic device 350 is configured in an exemplary embodiment to provide one or more sets of information to the controller 100 via the external communication bus 320 and/or to receive one or more sets of information from the controller 100 via the external communication bus 320. In one exemplary embodiment, the electronic device 350 is coupleable to the controller 100 via a Universal Serial Bus (USB) connection via the network interface 130.

The controller 100 may include or otherwise be coupleable to command software, such as a web-server, configured to provide a remote browser interface (such as to an electronic device 340, 350 as described below with reference to FIG. 3). The command software may enable one or more programming or configuration operations to be performed by the controller 100, may enable communication of at least one set of programming or configuration information between an electronic device 340, 350 remote from the controller 100, or the like.

An output of a network interface 130 may be coupled to an internal bus 380. The internal bus 380 may be further coupled to at least one of an amplifier 360 and/or one or more repeaters 370. Each repeater 370 may be coupled to at least one device 390 via a device bus 392 (e.g., devices 390*a-f*). Additionally or alternatively, at least one device 390 may be coupleable to the controller 100 via the network interface 130 without the use of an amplifier 360 (e.g., as illustrated with reference to devices 390*g*, 390*h*), and/or one or more repeaters 370 may be directly coupled to the amplifier 360 without being directly coupled to the controller 100.

Figure 4:
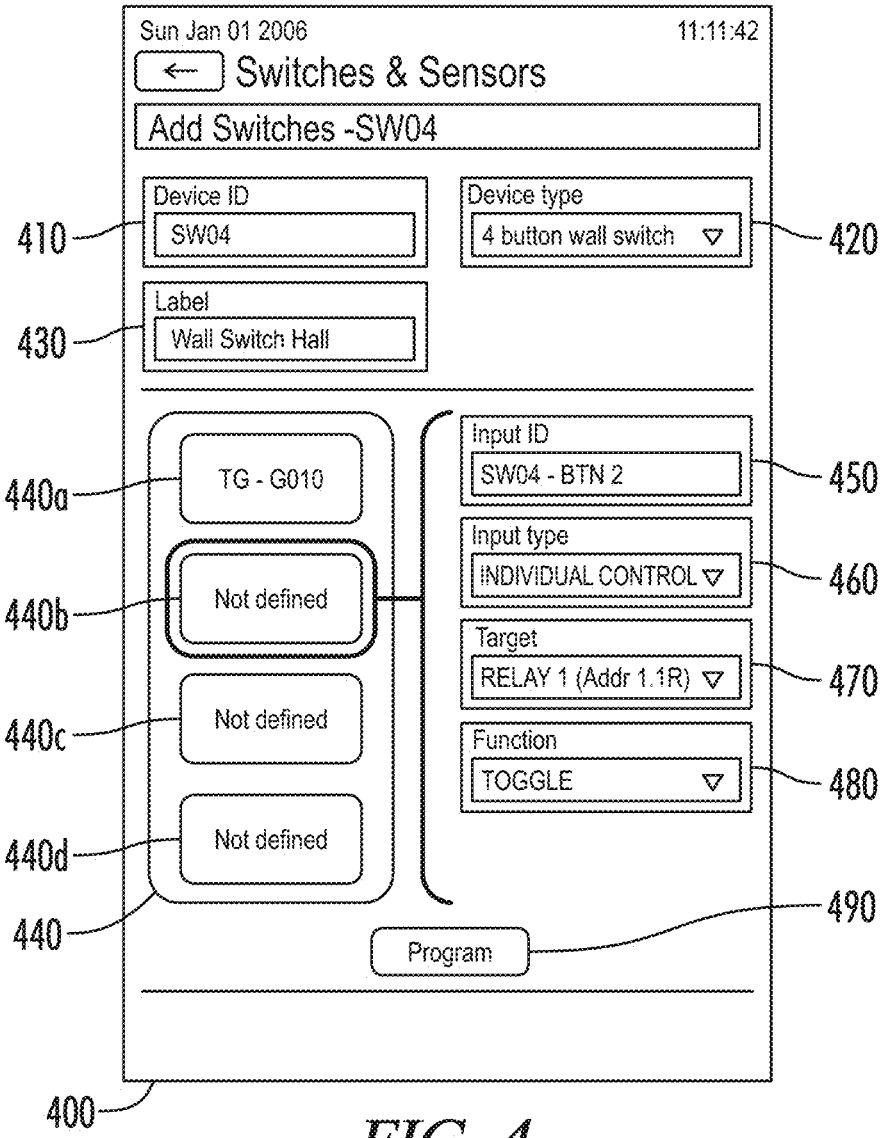
FIG. 4 illustrates an exemplary embodiment of a device configuration interface provided according to aspects of the present disclosure.

FIG. 4 illustrates an exemplary embodiment of a device configuration interface provided according to aspects of the present disclosure. The interface 400 includes a device identifier (ID) section 410, a device type section 420, a device label section 430, a virtual device layout section 440, an input ID section 450, an input type section 460, a target section 470, a function section 480, and/or a program selector 490. The interface 400 may be provided via the display section 120 of the controller 100 and/or may be provided to a remote electronic device 340, 350 as described herein. The device ID section 410 may provide or allow to be provided an identifier of a device 390. In the embodiment illustrated by FIG. 4, the device ID is a wall switch SW04. However, any device type or identifier may be associated with the device ID section 410. The device type section 420 may provide or allow to be provided a type of device identified in the device ID section 410. For example, in the embodiment illustrated by FIG. 4, the device type is a four button wall switch. The device label section 430 provides or allows to be provided a label associated with a device 390. The label may be predefined or may be installation-specific, such as a physical or logical location associated with a device 390.

The virtual device layout section 440 may provide a visual, virtual representation of a device 390 identified in the device ID section 410. The virtual device layout section 440 may permit a user to select one or more inputs of a device 390 to program or configure. For example, in the embodiment illustrated by FIG. 4, a first element 440*a* has been configured, a second element 440*b* is being configured, and third and fourth elements 440*c*, 440*d* have not yet been configured. With the second element 440*b* selected, the input ID section 450 identifies the device ID SW04 corresponding to the device ID section 410, and an input identified BTN 2 of the second element 440*b*. The input type section 460 identifies an input type, such as an individual control scheme or a group control scheme. The target section 470 optionally identifies a component address identifier, such as a relay address. The function section 480 identifies one or more functions associated with a selected element. In the embodiment illustrated by FIG. 4, the function section 480 identifies that the second element 440*b* is configured as a toggle element. The interface 400 further includes a program selector 490. The program selector 490 may be a touchscreen element in conjunction with the display section 120, or may be any other selectable element, such as in an embodiment where the interface 400 or representation thereof is provided to a remote electronic device 340, 350.

During operation, configuration information may be entered via the input interface 122 of the display section 120 (either by manual selection by touchscreen or by remote entry or remote access via a communication network functioning as a remote interface). The controller 100 is then capable of placing a communication network of the control system into a programming mode and to transmit at least one configuration parameter (which by itself and in relation to associated information may also be referred to herein as configuration information or configuration data) based at least in part upon a device type of a device 390 in relation to the entered configuration information. A user U1 may select an input of the device 390 (e.g., by physically pressing an input button of the device 390 (performing a programming request at the device 390). Once the input selection of the device 390 is detected either by the device 390 and/or by the controller 100, the device 390 is configured to perform at least one modification to an operational setting. The operational setting may include, for example, an ON/OFF value, a dimming setting, a schedule parameter, a detection type, or any other parameter relating to the device 390. At least one of the controller 100 and/or the device 390 may be configured to verify successful implementation of the modification to the operational setting.

The embodiment illustrated by FIG. 4 represents an example of programming a switch used to control ON/OFF dimming, scenes, or modes of operation for a lighting control system. Similar inputs and sections may be implemented for other devices 390, such as occupancy sensors or output devices such as dimming cards. During operation in the illustrated example, a user may enter information into one or more fields of the interface 400. In an exemplary embodiment, a user is prompted to enter information into each of the device ID section 410, the device type section 420, and the device label section 430. Based upon the entered information, a virtual device layout section is selected corresponding to the entered device information. Additional fields are presented to the user, for example in the form of function and target sections in the embodiment illustrated in FIG. 4. Once any button(s) for a device 390 are defined, a user may select the program selector 490 to perform at least one programming or configuration operation associated with the specified device 390.

Once the program selector 490 is selected from an interface 400 for adding a device, all devices 390 having a same device type as the device identified in the device ID section 410 may be programmed (e.g., "flashed"). An installer may then select an element of a device 390 intended to be programmed (e.g., by pressing a particular button or input element), at which time the device settings will be pushed to the device. The controller 100 may store the inputted device information and settings, and may be capable of permitting a user to view and/or modify at least one of the inputted device information and/or settings (e.g., under a device information page).

Figure 5:
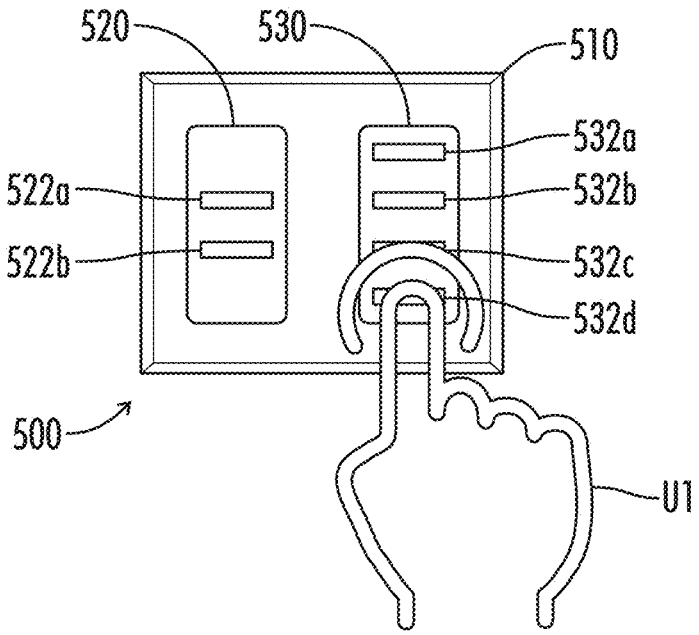
FIG. 5 illustrates an exemplary embodiment of a step of programming a device according to aspects of the present disclosure.

FIG. 5 illustrates an exemplary embodiment of a step of programming a device according to aspects of the present disclosure. The system 500 includes a combined device 510 having a plurality of devices 390, identified respectively as two input switch 520 and four input switch 530. The two input switch 520 includes two inputs 522*a*, 522*b*. The four input switch 530 includes four inputs 532*a*, 532*b*, 532*c*, 532*d*. As described above with reference to the program selection 490, a user U1 may cause at least one of the two input switch 520 or the four input switch 530 to be programmed or configured upon selection of an input of the at least one of the two input switch 520 or the four input switch 530. In the example illustrated by FIG. 5, the user U1 may program at least one input of the four input switch 530 by physically pressing the input 532*d* (e.g., providing a programming request at the device 390). Although illustrated and described as s single physical contact with an input, it should be appreciated that the user U1 may be required to select a plurality of inputs, to provide a predetermined selection pattern or timing, or any other input sequencing or timing scheme to place a device 390 in a condition to implement the programming or configuration provided by a centralized controller 100.

In various implementations, the controller 100 may be coupled to a plurality of switches and sensors via a two-wire network coupled to the network interface 130. The controller 100 may be configured to provide lighting control across an entire controlled space while still providing capability to control each room or segment of the controlled space. The display section 120 may be a 6.25×3.75 inch touchscreen interface capable of adding or changing system settings. A web browser provided locally at the controller 100 or accessible by the controller 100 may permit direct or indirect access to the controller 100 over a local or external network, such as the Internet. The network interface 130 may include a USB port configured to permit memory backup operations associated with the controller 100. The controller 100 may include diagnostic abilities and access to native BACnet capabilities, thereby allowing the controller 100 to operate as a central component of a Building Management System.

The controller 100 may be configured to program scenes, to store group information, and to run time schedules. The controller 100 is configured in one exemplary embodiment to manage a system of up to 252 relays and dimmers. For large-scale implementations, a plurality of controllers 100 each controlling a particular portion of the large-scale implementation may be managed by a centralized control station, for example implemented by a master controller 100, a server system, or any other electronic device capable of coordinating operations of the plurality of controllers 100.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A method of configuring a device of a lighting control system, the method comprising:

providing a configuration interface by a centralized controller of the lighting control system;

receiving device configuration information via the configuration interface, wherein the device configuration information comprises a device type;

placing a communication network of the lighting control system into a programming mode, wherein one or more elements are caused to flash for each of one or more devices coupled to the lighting control system and matching the received device type;

detecting a programming request received from a first device of the one or more devices coupled to the lighting control system and matching the received device type; and transmitting configuration data representing at least a portion of the received device configuration information from the centralized controller to the first device.

2. The method of claim 1, further comprising:

receiving the configuration data at the first device; and modifying at least one setting of the first device based at least in part upon the received configuration data.

3. The method of claim 1, wherein the detecting the programming request received at the first device comprises detecting a physical input at the first device.

4. The method of claim 1, wherein the configuration interface is presented to a user via a display section of the controller.

5. The method of claim 1, wherein the providing the configuration interface by the centralized controller comprises providing remote access to the controller via a communication network.

6. A control system for configuring devices, comprising:

a communication network;

one or more devices coupled to the communications network, each of the one or more devices including at least one input;

a centralized controller, having a network interface;

a storage section;

a display section configured to provide an input interface, the display section configured to display at least one configuration parameter corresponding to the input interface;

a processing section configured to receive a configuration parameter via the input interface, wherein the configuration parameter is associated with a particular device type, to define at least one setting associated with the configuration parameter, to place the communications network into a programming mode via the network interface, wherein one or more elements are caused to flash for each of the one or more devices coupled to the communications network and matching the device type, to store at least a portion of the configuration parameter at the storage section, and to transfer at least one set of programming information to a first device of the one or more devices via the network interface while the communications network is in the programming mode and after determining that the input of the first device was selected.

7. The control system of claim 6, wherein each of the one or more devices has an associated configuration designation, the configuration designation configured to enable programming of the respective device while the communications network operates in the programming mode.

8. The control system of claim 6, wherein the control system is a lighting control system comprising a plurality of relays and at least one configurable input device.

9. The control system of claim 6, wherein each of the one or more devices is configured to receive the configuration parameter and to modify at least one setting of the respective device based at least in part upon the received configuration parameter.

10. The control system of claim 6, wherein the determining that the input of the first device was selected comprises detecting, by the first device, a physical user interaction at the input of the first device.

11. The control system of claim 6, wherein the controller is configured to transmit the configuration parameter to all devices coupled to the control system matching the received device type.

12. The control system of claim 6, wherein the input interface is configured to be presented to a user via the display section of the controller.

13. The control system of claim 6, wherein the controller is configured to provide remote access to at least a portion of the input interface via a communication network.

14. A method of configuring a device of a lighting control system, the method comprising:

providing a configuration interface by a centralized controller of the lighting control system;

receiving device configuration information via the configuration interface, wherein the device configuration information comprises a device type of the device;

placing a communication network of the lighting control system into a programming mode;

detecting a programming request received at the device; and transmitting configuration data representing at least a portion of the received device configuration information from the centralized controller to all devices coupled to the lighting control system matching the received device type.

15. The method of claim 14, further comprising:

receiving the configuration data at the devices coupled to the lighting control system matching the received device type; and modifying at least one setting of the respective devices based at least in part upon the received configuration data.

16. The method of claim 14, wherein the detecting the programming request received at the device comprises detecting a physical input at the device.

17. The method of claim 14, wherein the configuration interface is presented to a user via a display section of the controller.

18. The method of claim 14, wherein the providing the configuration interface by the centralized controller comprises providing remote access to the controller via a communication network.

* * * * *